US011293085B2

(12) United States Patent
Satoh

(10) Patent No.: US 11,293,085 B2
(45) Date of Patent: Apr. 5, 2022

(54) MNAL ALLOY AND MANUFACTURING METHOD THEREFOR

(71) Applicant: TDK CORPORATION, Tokyo (JP)

(72) Inventor: Suguru Satoh, Tokyo (JP)

(73) Assignee: TDK CORPORATION, Tokyo (JP)

( * ) Notice: Subject to any disclaimer, the term of this patent is extended or adjusted under 35 U.S.C. 154(b) by 160 days.

(21) Appl. No.: 16/452,872

(22) Filed: Jun. 26, 2019

(65) Prior Publication Data

US 2020/0002797 A1 Jan. 2, 2020

(30) Foreign Application Priority Data

Jun. 30, 2018 (JP) ..... JP2018-125636

(51) Int. Cl.
*C22F 1/18* (2006.01)
*C25D 3/66* (2006.01)
*C22C 22/00* (2006.01)

(52) U.S. Cl.
CPC ..... *C22F 1/18* (2013.01); *C22C 22/00* (2013.01); *C25D 3/66* (2013.01)

(58) Field of Classification Search
CPC ..... C22F 1/18; C25D 3/66; C22C 22/00
See application file for complete search history.

(56) References Cited

U.S. PATENT DOCUMENTS

2016/0307677 A1* 10/2016 Baker ..... H03H 9/02448
2019/0338401 A1 11/2019 Irie et al.
2019/0338406 A1 11/2019 Satoh et al.
2020/0002790 A1 1/2020 Satoh

FOREIGN PATENT DOCUMENTS

CN 107312982 A 11/2017
JP S36-11110 9/1958
JP 2014228166 A 12/2014
JP 2017045824 A 3/2017

OTHER PUBLICATIONS

Grushko, Benjamin, Stafford, Gery R., Phase Formation in Electrodeposited and Thermally Annealed Al—Mn Alloys, Metallurgical Transactions A, vol. 21A, Nov. 1990, 11 pages.

* cited by examiner

*Primary Examiner* — Anthony J Zimmer
*Assistant Examiner* — Jacob J Gusewelle
(74) *Attorney, Agent, or Firm* — Young Law Firm, P.C.

(57) ABSTRACT

A MnAl alloy according to the present invention exhibits metamagnetism and has crystal grains containing a τ-MnAl phase and crystal grains containing a γ2-MnAl phase and a β-MnAl phase. When the ratio of the τ-MnAl phase is A, 75%≤A≤99% is preferably satisfied, and when the ratios of the γ2-MnAl phase and β-MnAl phase are B and C, respectively, B<C is preferably satisfied. Thus, it is possible to obtain metamagnetism over a wide temperature range, particularly, over a temperature range of −100° C. to 200° C. and to enhance saturation magnetization.

6 Claims, 12 Drawing Sheets

| Samples | Manufacturing Process | Electrodeposition Temperature (℃) | Heat Treatment Temperature (℃) | Phase | τ-MnAl ratio (%) | γ2phase/β-phase intensity ratio | Mn ratio in MnAl Array (Atom%) | Antiferromagnetic Structure | Metamagnetism | maximum magnetization σmax (emu/g) | Residual Magnetization σr (emu/g) | Squareness Ratio σr/σmax | Residual Magnetization in room temperature |
|---|---|---|---|---|---|---|---|---|---|---|---|---|---|
| Comparative Example 1 | Electrodeposition Method | 200 | – | τ | 100 | 0 | 45.2 | Yes | No | 51.2 | 4.6 | 0.09 | No |
| Comparative Example 2 | Electrodeposition Method | 250 | – | τ | 100 | 0 | 46.9 | Yes | No | 69.2 | 11.1 | 0.16 | Yes |
| Comparative Example 3 | Electrodeposition Method | 300 | – | τ | 100 | 0 | 49 | Yes | No | 87.2 | 20.8 | 0.2 | Yes |
| Comparative Example 4 | Electrodeposition Method | 350 | – | τ | 100 | 0 | 49.3 | Yes | No | 109.0 | 18.7 | 0.17 | Yes |
| Comparative Example 5 | Electrodeposition Method | 400 | – | τ | 100 | 0 | 49.9 | Yes | No | 127.8 | 22.5 | 0.18 | Yes |
| Comparative Example 6 | Electrodeposition Method | 450 | – | τ | 100 | 0 | 50.1 | Yes | No | 128.4 | 17.9 | 0.14 | Yes |
| Comparative Example 7 | Electrodeposition Method | 500 | – | τ/γ2 | 95 | ∞ | 49.3 | Yes | No | 89.3 | 18.8 | 0.21 | Yes |
| Example 1 | Electrodeposition Method | 200 | 400 | τ/γ2/β | 88.8 | 3.65 | 45.2 | Yes | Yes | 31.2 | 9 | 0.29 | Yes |
| Example 2 | Electrodeposition Method | 200 | 450 | τ/γ2/β | 83.7 | 3.96 | 45.2 | Yes | Yes | 31.2 | 4.9 | 0.16 | Yes |
| Example 3 | Electrodeposition Method | 200 | 500 | τ/γ2/β | 81 | 4.49 | 45.2 | Yes | Yes | 26 | 2.4 | 0.09 | No |
| Example 4 | Electrodeposition Method | 200 | 550 | τ/γ2/β | 76.3 | 3.15 | 45.2 | Yes | Yes | 25.5 | 0 | 0 | No |
| Comparative Example 8 | Electrodeposition Method | 200 | 600 | τ/γ2/β | 29.9 | 1.19 | 45.2 | Yes | No | 20.7 | 0.3 | 0.01 | No |
| Example 5 | Electrodeposition Method | 250 | 400 | τ/γ2/β | 92.6 | 2.75 | 46.9 | Yes | Yes | 58.4 | 15.6 | 0.27 | Yes |
| Example 6 | Electrodeposition Method | 250 | 450 | τ/γ2/β | 90 | 3.4 | 46.9 | Yes | Yes | 71.6 | 6.3 | 0.09 | No |
| Example 7 | Electrodeposition Method | 250 | 500 | τ/γ2/β | 89.3 | 4.14 | 46.9 | Yes | Yes | 64.7 | 0.2 | 0 | No |
| Example 8 | Electrodeposition Method | 250 | 550 | τ/γ2/β | 75.7 | 1.2 | 46.9 | Yes | Yes | 47.9 | 0.2 | 0 | No |
| Comparative Example 9 | Electrodeposition Method | 250 | 600 | τ/γ2/β | 20 | 0.55 | 46.9 | Yes | No | 13.6 | 0.6 | 0.04 | No |
| Example 9 | Electrodeposition Method | 300 | 400 | τ/γ2/β | 97 | 0.47 | 49 | Yes | Yes | 95 | 23.8 | 0.25 | Yes |
| Example 10 | Electrodeposition Method | 300 | 450 | τ/γ2/β | 97.4 | 0.83 | 49 | Yes | Yes | 116.1 | 12.8 | 0.11 | Yes |
| Example 11 | Electrodeposition Method | 300 | 500 | τ/γ2/β | 97 | 1.29 | 49 | Yes | Yes | 115.7 | 1.2 | 0.01 | No |
| Example 12 | Electrodeposition Method | 300 | 550 | τ/γ2/β | 87 | 0.31 | 49 | Yes | Yes | 103.1 | 1 | 0.01 | No |
| Comparative Example 10 | Electrodeposition Method | 300 | 600 | τ/γ2/β | 5.2 | 0.23 | 49 | Yes | No | 9.2 | 0.1> | 0 | No |
| Example 13 | Electrodeposition Method | 350 | 400 | τ/γ2/β | 98.3 | 0.02 | 49.3 | Yes | Yes | 121.5 | 14.9 | 0.12 | Yes |
| Example 14 | Electrodeposition Method | 350 | 450 | τ/γ2/β | 97.8 | 0.04 | 49.3 | Yes | Yes | 134.7 | 6.9 | 0.05 | No |
| Example 15 | Electrodeposition Method | 350 | 500 | τ/γ2/β | 97.5 | 0.07 | 49.3 | Yes | Yes | 137.5 | 1.5 | 0.01 | No |
| Example 16 | Electrodeposition Method | 350 | 550 | τ/γ2/β | 96.7 | 0.17 | 49.3 | Yes | Yes | 131.8 | 0.5 | 0 | No |
| Comparative Example 11 | Electrodeposition Method | 350 | 600 | τ/γ2/β | 9.9 | 0.15 | 49.3 | Yes | No | 12.4 | 0.1> | 0.01 | No |
| Example 17 | Electrodeposition Method | 400 | 400 | τ/γ2/β | 96.3 | 0.02 | 49.9 | Yes | Yes | 133.8 | 10.8 | 0.08 | No |
| Example 18 | Electrodeposition Method | 400 | 450 | τ/γ2/β | 95.6 | 0.02 | 49.9 | Yes | Yes | 137.3 | 2.9 | 0.02 | No |
| Example 19 | Electrodeposition Method | 400 | 500 | τ/γ2/β | 95.8 | 0.07 | 49.9 | Yes | Yes | 138.2 | 1.9 | 0.01 | No |
| Example 20 | Electrodeposition Method | 400 | 550 | τ/γ2/β | 95.7 | 0.08 | 49.9 | Yes | Yes | 132 | 1.7 | 0.01 | No |
| Comparative Example 12 | Electrodeposition Method | 400 | 600 | τ/γ2/β | 21.2 | 0.16 | 49.9 | Yes | No | 20.3 | 1.7 | 0.08 | No |
| Example 21 | Electrodeposition Method | 450 | 400 | τ/γ2/β | 96.7 | 0.01 | 50.1 | Yes | Yes | 139.4 | 9.5 | 0.07 | No |
| Example 22 | Electrodeposition Method | 450 | 450 | τ/γ2/β | 95.9 | 0.01 | 50.1 | Yes | Yes | 140.2 | 2.3 | 0.02 | No |
| Example 23 | Electrodeposition Method | 450 | 500 | τ/γ2/β | 95.8 | 0.04 | 50.1 | Yes | Yes | 139.1 | 0.5 | 0 | No |
| Example 24 | Electrodeposition Method | 450 | 550 | τ/γ2/β | 95.7 | 0.07 | 50.1 | Yes | Yes | 138.1 | 1.3 | 0.01 | No |
| Comparative Example 13 | Electrodeposition Method | 450 | 600 | τ/γ2/β | 21.2 | 0.1 | 50.1 | Yes | No | 38.2 | 3 | 0.08 | No |
| Example 25 | Electrodeposition Method | 500 | 400 | τ/γ2/β | 91.1 | 0.36 | 49.3 | Yes | Yes | 88.1 | 24 | 0.27 | Yes |
| Example 26 | Electrodeposition Method | 500 | 450 | τ/γ2/β | 90.8 | 0.58 | 49.3 | Yes | Yes | 112.1 | 9 | 0.08 | No |
| Example 27 | Electrodeposition Method | 500 | 500 | τ/γ2/β | 90.4 | 0.68 | 49.3 | Yes | Yes | 113.8 | 0.8 | 0.01 | No |
| Example 28 | Electrodeposition Method | 500 | 550 | τ/γ2/β | 87.2 | 0.58 | 49.3 | Yes | Yes | 102.4 | 0.4 | 0 | No |
| Comparative Example 14 | Electrodeposition Method | 500 | 600 | τ/γ2/β | 32.7 | 0.21 | 49.3 | Yes | No | 29.2 | 4.2 | 0.14 | Yes |
| Comparative Example 15 | Melting Method | – | – | τ | 100 | 0 | 55 | No | No | 108.0 | 43.2 | 0.4 | Yes |

FIG. 9

Heat Treatment Temperature

| Electrodeposition Tempe | As dep. | 400 | 450 | 500 | 550 | 600 |
|---|---|---|---|---|---|---|
| 200 | 51.2 | 31.2 | 31.2 | 26 | 25.5 | 20.7 |
| 250 | 69.2 | 58.4 | 71.6 | 64.7 | 47.9 | 13.6 |
| 300 | 87.2 | 95 | 116.1 | 115.7 | 103.1 | 9.2 |
| 350 | 109 | 121.5 | **134.7** | **137.5** | **131.8** | 12.4 |
| 400 | 127.8 | **133.8** | **137.3** | **138.2** | **132** | 20.3 |
| 450 | 128.4 | **139.4** | **140.2** | **139.1** | **138.1** | 38.2 |
| 500 | 89.3 | 88.1 | 112.1 | 113.8 | 102.4 | 29.2 |

FIG.13A

Heat Treatment Temperature

| Electrodeposition Tempe | As dep. | 400 | 450 | 500 | 550 | 600 |
|---|---|---|---|---|---|---|
| 200 | 100 | 88.8 | 83.7 | 81 | 76.3 | 29.9 |
| 250 | 100 | 92.6 | 90 | 89.3 | 75.7 | 20 |
| 300 | 100 | **97** | **97.4** | **97** | 87 | 5.2 |
| 350 | 100 | **98.3** | **97.8** | **97.5** | **96.7** | 9.9 |
| 400 | 100 | **96.3** | **95.6** | **95.8** | **95.7** | 21.2 |
| 450 | 100 | **96.7** | **95.9** | **95.8** | **95.7** | 21.2 |
| 500 | 95 | 91.1 | 90.8 | 90.4 | 87.2 | 32.7 |

FIG.13B

Heat Treatment Temperature

| Electrodeposition Tempe | As dep. | 400 | 450 | 500 | 550 | 600 |
|---|---|---|---|---|---|---|
| 200 | 0 | 3.65 | 3.96 | 4.49 | 3.15 | 1.19 |
| 250 | 0 | 2.75 | 3.4 | 4.14 | 1.2 | 0.55 |
| 300 | 0 | 0.47 | 0.83 | 1.29 | 0.31 | 0.23 |
| 350 | 0 | **0.02** | **0.04** | **0.07** | **0.17** | 0.15 |
| 400 | 0 | **0.02** | **0.02** | **0.07** | **0.08** | 0.16 |
| 450 | 0 | **0.01** | **0.01** | **0.04** | **0.07** | 0.1 |
| 500 | ∞ | 0.36 | 0.58 | 0.68 | 0.58 | 0.21 |

FIG.13C

| Sample | Measurement Temperature (°C) | Inflection Point of Magnetization Curve at Measurement Temperature |
|---|---|---|
| Comparative Example 3 | -100 | No |
| | -50 | No |
| | 25 | No |
| | 50 | No |
| | 100 | No |
| | 150 | No |
| | 200 | No |
| Example 11 | -100 | Yes |
| | -50 | Yes |
| | 25 | Yes |
| | 50 | Yes |
| | 100 | Yes |
| | 150 | Yes |
| | 200 | Yes |
| Comparative Example 15 | -100 | No |
| | -50 | No |
| | 25 | No |
| | 50 | No |
| | 100 | No |
| | 150 | No |
| | 200 | No |

FIG.14

MNAL ALLOY AND MANUFACTURING METHOD THEREFOR

BACKGROUND OF THE INVENTION

Field of the Invention

The present invention relates to a MnAl alloy and a manufacturing method therefore and, more particularly, to a MnAl alloy having metamagnetism and a manufacturing method therefor.

Description of Related Art

A MnAl alloy is hitherto known as a magnetic material. For example, the MnAl alloy disclosed in JP S36-11110 B has a tetragonal structure and has a Mn/Al ratio of 5:4 to thereby exhibit magnetism. Further, J P 2017-45824 A describes that by making a first phase composed of MnAl alloy having a tetragonal structure and a second phase composed of $Al_8Mn_5$ crystal grains coexist, the MnAl alloy can be utilized as a permanent magnet having high coercive force.

Further, as disclosed in JP 2014-228166 A, it is known that some of the magnetic materials having Mn as a main constituent element exhibit metamagnetism. The metamagnetism refers to a property in which magnetism undergoes transition from paramagnetism or antiferromagnetism to ferromagnetism by a magnetic field. A metamagnetic material exhibiting the metamagnetism is expected to be applied to a magnetic refrigerator, an actuator, and a current limiter.

However, the metamagnetic materials described in JP 2014-228166 A all utilize first-order phase transition from paramagnetism to ferromagnetism by a magnetic field, so that they exhibit the metamagnetism only in the vicinity of the Curie temperature. Thus, practically, it is difficult to apply the metamagnetic materials to a current limiter and the like.

SUMMARY

The present invention has been made in view of the above situation, and the object thereof is to provide a Mn-based alloy exhibiting the metamagnetism over a wide temperature range.

To solve the above problem and attain the object, the present inventor focused on a meta magnetic material (hereinafter, referred to as "AFM-FM transition type metamagnetic material") of a type undergoing transition from antiferromagnetism to ferromagnetism by a magnetic field. This is for the following reason: the AFM-FM transition type metamagnetic material exhibits metamagnetism at a temperature equal to or less than the Neel temperature where the antiferromagnetism order disappears, so that, unlike a metamagnetic material (hereinafter, referred to as "PM-FM transition type metamagnetic material") of a type undergoing transition from paramagnetism to ferromagnetism, it is not necessary to maintain a narrow temperature zone around the Curie temperature.

High crystal magnetic anisotropy and antiferromagnetism are required for realizing AFM-FM transition type metamagnetism. Thus, the present inventors focused on a Mn-based magnetic material using Mn exhibiting antiferromagnetism alone as the AFM-FM transition type metamagnetic material and examined various alloys/compounds. As a result, it was found that metamagnetism was exhibited over a wide temperature range by imparting an antiferromagnetic element to MnAl alloy which is a comparatively rare Mn-based alloy that exhibits ferromagnetism. The present invention has been made based on the above finding, and a MnAl alloy according to the present invention is characterized by having metamagnetism and including crystal grains containing a τ-MnAl phase and crystal grains containing a γ2-MnAl phase and a β-MnAl phase.

That is, the crystal grains of the τ-MnAl phase exhibit ferromagnetism alone, and the crystal grains of the γ2-MnAl phase and β-MnAl phase exhibit non-magnetism, while when the τ-MnAl phase, γ2-MnAl phase, and β-MnAl phase coexist, antiferromagnetism is imparted to the τ-MnAl phase, whereby AFM-FM transition type metamagnetism is realized.

When the ratio of the τ-MnAl phase is A, by setting the value of A so as to satisfy $75\% \leq A \leq 99\%$, saturation magnetization can be enhanced, and by setting the value of A so as to satisfy $95\% \leq A \leq 99\%$, saturation magnetization can be further enhanced. Further, when the ratios of the γ2-MnAl phase and β-MnAl phase are B and C, respectively, by setting the values of B and C so as to satisfy $B<C$, saturation magnetization can be enhanced, and by setting the values of B and C so as to satisfy $0.01 \leq B/C \leq 0.17$, saturation magnetization can be further enhanced.

The MnAl alloy according to the present invention preferably has the magnetic structure of the τ-MnAl phase preferably has an antiferromagnetic structure. By using the MnAl-based alloy whose antiferromagnetism is stable in a non-magnetic field state before phase transition, an AFM-FM transition type meta magnetic material is realized. When the stability of the antiferromagnetic state is too high, it is impossible to make phase transition to ferromagnetism by a magnetic field. On the other hand, when the stability of the antiferromagnetism is too low, phase transition to ferromagnetism may occur even with non-magnetic field or very weak magnetic field. In the MnAl alloy, an antiferromagnetic state is adequately stable, so that by imparting AFM-FM transition type metamagnetism, it is possible to obtain metamagnetism over a wide temperature range.

A mechanism of antiferromagnetism in the τ-MnAl phase is ferromagnetized by adjusting the amount of Mn on the Al site was examined by a first principle calculation, and it was found that the antiferromagnetism is caused by super exchange interaction between Mn atoms on the Mn site through p-orbital valence electrons in Al atoms in the Al site. The super exchange interaction is a kind of mechanism of exchange interaction in which 3d-orbital valence electrons of transition metal atoms work through orbital mixing with the p-orbital valence electrons in atoms having p-orbital valence electrons called ligand. When the angle among the transition metal atom, ligand, and transition metal atom experiencing coupling is close to 180°, antiferromagnetic coupling occurs. That is, in the τ-MnAl phase, the angle among Mn on the Mn site, Al on the Al site which is the ligand, and Mn in the directions (1, 1, 0) and (1, 1, 1) from the Mn site is close to 180°, and thus the antiferromagnetic coupling occurs. In addition, when Mn atoms are substituted on the Al site, the super exchange interaction does not occur between Mn atoms on the Mn site, and thus an antiferromagnetic structure is difficult to form. From the above findings, it was found that the stability of antiferromagnetism can be adjusted by adjusting the amount Mn on the Al site in the τ-MnAl phase.

A MnAl alloy manufacturing method according to the present invention includes a step of depositing a MnAl alloy by electrolyzing molten salt containing a Mn compound and an Al compound at a temperature of 350° C. or more and 450° C. or less and a step of applying heat treatment to the MnAl alloy at a temperature of 400° C. or more and less than 600° C. By thus applying heat treatment to the MnAl alloy formed by a molten salt electrolysis method performed at a predetermined temperature, it is possible to impart metamagnetism to the MnAl alloy and to enhance saturation magnetization.

As described above, according to the present invention, there can be provided a MnAl alloy exhibiting metamagnetism over a wide temperature range.

BRIEF DESCRIPTION OF THE DRAWINGS

The above features and advantages of the present invention will be more apparent from the following description of certain preferred embodiments taken in conjunction with the accompanying drawings, in which:

FIG. 6 is a graph illustrating the second order differential value of the characteristics illustrated in

FIG. 4;

FIG. 9 is a first table indicating evaluation results of Examples and Comparative examples;

FIG. 13A, FIG. 13B and FIG. 13C are tables showing the maximum magnetization, τ-phase ratio, and γ2-phase/β-phase intensity ratio, respectively, rearranged in terms of the electrodeposition temperature and heat treatment temperature; and FIG. 14 is a second table indicating evaluation results of Example 11 and Comparative examples 3 and 15.

DETAILED DESCRIPTION OF THE EMBODIMENTS

Hereinafter, preferred embodiments of the present invention will be described. The present invention is not limited to the embodiments and examples described below. Further, the constituent elements shown in the following embodiments and examples can be appropriately combined or selected for use.

The metamagnetism refers to a property in which magnetism undergoes first-order phase transition from paramagnetism (PM) or antiferromagnetism (AFM) to ferromagnetism (FM) by a magnetic field. The first-order phase transition by a magnetic field refers to the occurrence of discontinuity in a change in magnetization under a magnetic field. The metamagnetic material is classified into a PM-FM transition type metamagnetic material in which magnetism undergoes transition from paramagnetism to ferromagnetism by a magnetic field and an AFM-FM transition type metamagnetic material in which magnetism undergoes transition from antiferromagnetism to ferromagnetism by a magnetic field. In the PM-FM transition type metamagnetic material, the first-order phase transition occurs only in the vicinity of the Curie temperature; on the other hand, in the AFM-FM transition type metamagnetic material, the first-order phase transition occurs at a temperature equal to or less than the Neel temperature where the antiferromagnetism order disappears. The MnAl alloy according to the present embodiment is the AFM-FM transition type metamagnetic material, so that it exhibits metamagnetism over a wide temperature range.

Figure 1:
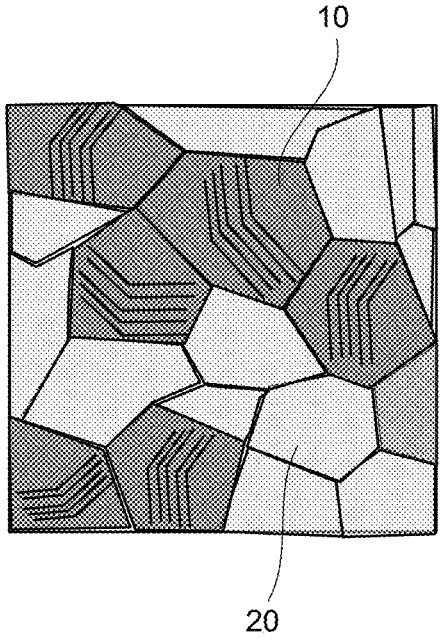
FIG. 1 is a schematic view illustrating the crystal grains of a MnAl alloy according to an embodiment of the present invention.

FIG. 1 is a schematic view illustrating the crystal grains of a MnAl alloy according to the present embodiment.

As illustrated in FIG. 1, the MnAl alloy according to the present embodiment has crystal grains 10 containing a τ-MnAl phase and crystal grains 20 containing a γ2-MnAl phase and a β-MnAl phase. The crystal grains 10 containing the τ-MnAl phase are a phase having ferromagnetism alone, and the crystal grains 20 containing the γ2-MnAl phase and β-MnAl phase are a phase not having ferromagnetism by itself. The crystal grains 10 containing the τ-MnAl phase may be a twin crystal. By making the crystal grains 10 containing the τ-MnAl phase and crystal grains 20 containing the γ2-MnAl phase and β-MnAl phase coexist, AFM-FM transition type metamagnetism is realized, and metamagnetism can be obtained over a wide temperature range. The τ-MnAl phase is a crystal phase having a tetragonal structure and has ferromagnetism alone and, when the γ2-MnAl phase and β-MnAl phase coexist with the τ-MnAl phase, antiferromagnetism is imparted to the τ-MnAl phase, whereby metamagnetism is exhibited.

The γ2-MnAl phase is also called $Al_8Mn_5$ phase, $Mn_{11}Al_{15}$ phase, r-MnAl phase, or γ-MnAl phase and refers to a crystal phase having a rhombohedral crystal structure and in which lattice constants a and b are about 1.26 nm, a lattice constant c is about 0.79 nm, and the ratio of Mn to Al is about 31 at % to 47 at %.

The β-MnAl phase refers to a crystal phase having a cubic crystal structure and in which the lattice constant is about 0.64 nm, and the ratio of Mn to Al is about 60 at % to 98 at %.

Further, according to the present embodiment, the magnetic structure of the τ-MnAl phase contained in the MnAl alloy has an antiferromagnetic structure. The antiferromagnetic structure refers to a structure in which spin as the origin of magnetism of a magnetic material has a spatially periodic structure, and magnetization (spontaneous magnetization) as the entire magnetic material is absent, which differs from a paramagnetic structure in which the spin does not have a spatially periodic structure but has a disordered structure, and magnetization as the entire magnetic material is absent. By using the MnAl alloy whose antiferromagnetism becomes stable in a non-magnetic field state before the phase transition, the AFM-FM transition type metamagnetic material can be realized. When the stability of the antiferromagnetic state is too high, a magnetic field required for magnetic phase transition to ferromagnetism becomes too large, substantially disabling the occurrence of magnetic phase transition by a magnetic field. On the other hand, when the stability of the antiferromagnetic state is too low, magnetic phase transition to ferromagnetism may occur even in a non-magnetic field state or with a very weak magnetic field. By adjusting the stability of the antiferromagnetic state and imparting the AFM-FM transition type metamagnetism, the MnAl alloy can exhibit metamagnetism over a wide temperature range.

The crystal grains 10 containing the τ-MnAl phase is preferably composed of only by the τ-MnAl phase having the antiferromagnetic structure but may partially contain a ferromagnetic structure, a paramagnetic structure, or a ferrimagnetic structure. Further, while the antiferromagnetic structure of the τ-MnAl phase in the MnAl alloy may have a colinear type antiferromagnetic structure having a constant spin axis or a noncolinear type antiferromagnetic structure having a non-constant spin axis as long as it exhibits the metamagnetism, the antiferromagnetic structure having a long-period magnetic structure is more applicable since a magnetic field required for transition from antiferromagnetism to ferromagnetism is small.

In order for the crystal grains 10 containing the τ-MnAl phase to have the antiferromagnetic structure, the Al site in the τ-MnAl phase is preferably occupied by Al. In this case, the atom occupying the Al site may be any atom that has p-orbital valence electrons. Specifically, B, Ga, In, Tl, C, Si, Ge, Sn, Pb, N, P, As, Sb, Bi, O, S, Se, Te, Po, F, Cl, Br, I, and At having the p-orbital valence electrons may be candidates therefor.

When the composition formula of the τ-MnAl phase is expressed by $Mn_aAl_{100-a}$, the MnAl alloy according to the present embodiment preferably satisfies $48 \leq a < 55$. When $a < 48$, the amount of Mn on the Al site becomes small, the stability of the antiferromagnetic state becomes very high, with the result that a magnetic field required for magnetic phase transition becomes large, which is disadvantageous for application. When $a \geq 55$, Mn is contained more than Al, so that Mn is easily substituted on the Al site. The Mn substituted on the Al site is coupled antiferromagnetically to Mn on the Mn site, whereby Mn atoms on the Mn site are coupled ferromagnetically. As a result, ferrimagnetism occurs in the entire τ-MnAl phase, making it difficult to obtain metamagnetism. By setting the ratio of Mn in the τ-MnAl phase so as to satisfy $48 \leq a < 55$, and by adjusting the stability of the antiferromagnetic state in a non-magnetic field state, it is possible to realize the AFM-FM transition type metamagnetism and thus to obtain meta magnetism over a wide temperature range.

The MnAl alloy according to the present embodiment is preferably composed of only the crystal grains 10 containing the τ-MnAl phase and the crystal grains 20 containing the γ2-MnAl phase and β-MnAl phase; however, it may contain different phases such as an amorphous phase as long as it has metamagnetism. Further, as long as metamagnetism is exhibited, the MnAl alloy may be a multicomponent MnAl alloy in which a part of the Mn site or a part of the Al site is substituted with Fe, Co, Cr, or Ni.

Although there is no particular restriction on the composition ratio between Mn and Al in the MnAl alloy, it is preferable that Mn is 45 at % or more and less than 55 at % and Al is more than 45 at % and 55 at % or less, and is particularly preferable that Mn is 45 at % or more and 52 at % or less. That is, when the composition thereof is expressed by $Mn_bAl_{100-b}$, $45 \leq b \leq 55$ is preferably satisfied, and more preferably, $45 \leq b \leq 52$ is satisfied. By setting the composition ratio between Mn and Al in this range, the crystal grains 10 containing τ-MnAl phase and the crystal grains 20 containing the γ2-MnAl phase and β-MnAl phase makes it more likely to coexist.

The ratio of Mn in the MnAl alloy can be controlled by temperature at electrodeposition to be described later. Specifically, the higher the electrodeposition temperature is, the higher the ratio of Mn in the τ-MnAl phase tends to be.

When the ratio of the τ-MnAl phase is A, $75\% \leq A \leq 99\%$ is preferably satisfied. This can enhance the saturation magnetization of the MnAl alloy. Particularly, when $95\% \leq A \leq 99\%$ is satisfied, the saturation magnetization of the MnAl alloy can be further enhanced. Further, when the ratios of the γ2-MnAl phase and β-MnAl phase are B and C, respectively, $B < C$ is preferably satisfied. This can enhance the saturation magnetization of the MnAl alloy. Particularly, when $0.01 \leq B/C \leq 0.17$ is satisfied, the saturation magnetization of the MnAl alloy can be further enhanced. This suggests that the saturation magnetization of the MnAl alloy having metamagnetism is determined not only by the ratio A of the τ-MnAl phase, but depends also on the ratio B/C between the γ2-MnAl phase and the β-MnAl phase.

Figure 2:
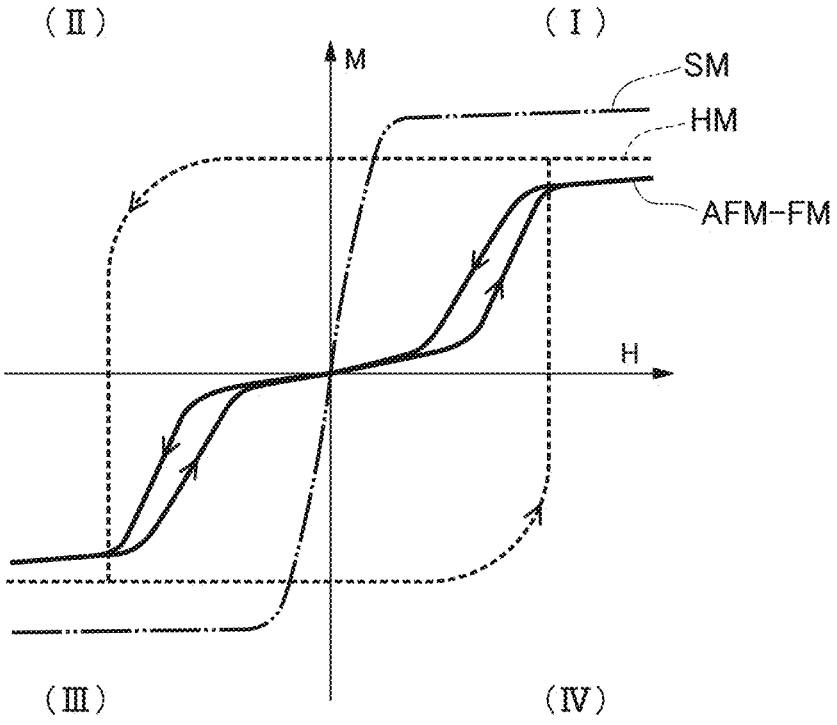
FIG. 2 is a graph illustrating the magnetic characteristics of various magnetic materials.

FIG. 2 is a graph illustrating the magnetic characteristics of various magnetic materials. In FIG. 2, the horizontal axis (X-axis) as a first axis indicates a magnetic field H, and the vertical axis (Y-axis) as a second axis indicates magnetization M. Further, in FIG. 2, "AFM-FM" indicates the magnetic characteristics of the MnAl alloy according to the present embodiment, "SM" indicates the magnetic characteristics of a general soft magnetic material, and "HM" indicates the magnetic characteristics of a general hard magnetic material.

As indicated by "SM" in FIG. 2, the typical soft magnetic material exhibits high permeability and is thus easily magnetized in the low magnetic field region, while when magnetic field strength exceeds a predetermined value, it is magnetically saturated and is hardly magnetized any further. In other words, in the magnetic field region where magnetic saturation does not occur, the differential value of the magnetization M with respect to the magnetic field H becomes large, while in the magnetic field region where magnetic saturation can occur, the differential value of the magnetization M with respect to the magnetic field H becomes small. Further, the typical soft magnetic material has no hysteresis or has very small hysteresis, so that the characteristic curve denoted by "SM" passes the origin of the graph or in the vicinity thereof. Therefore, the characteristic curve denoted by "SM" appears in the first quadrant (I) and third quadrant (III) of the graph and does not substantially appear in the second quadrant (II) and fourth quadrant (IV).

As indicated by "HM" in FIG. 2, the typical hard magnetic material has large hysteresis, and thus a magnetized state is maintained even with zero magnetic field. Therefore, the characteristic curve denoted by "HM" appears in all the first (I) to fourth (IV) quadrants.

On the other hand, as indicated by "AFM-FM" in the first and third quadrants (I) and (III) of the graph, the MnAl alloy according to the present embodiment exhibits the following characteristics: in the low magnetic region, it exhibits low permeability and is thus hardly magnetized; in the middle magnetic field region, it exhibits increased permeability and is easily magnetized; and in the high magnetic field region, it is magnetically saturated and is hardly magnetized any further. While slight hysteresis exists in the first and third quadrants (I) and (III) depending on electrodeposition conditions and heat treatment conditions described later, residual magnetization is zero or very small, so that the characteristic curve denoted by "AFM-FM" substantially passes the origin of the graph. Even when the characteristic curve denoted by "AFM-FM" does not pass exactly the origin of the graph, it passes in the vicinity of the origin with respect to the horizontal or vertical axis. This means that the same magnetic characteristics can be obtained irrespective of whether the MnAl alloy according to the present embodiment is in the initial state or in a state after it has repeatedly been applied with a magnetic field.

Figure 3:
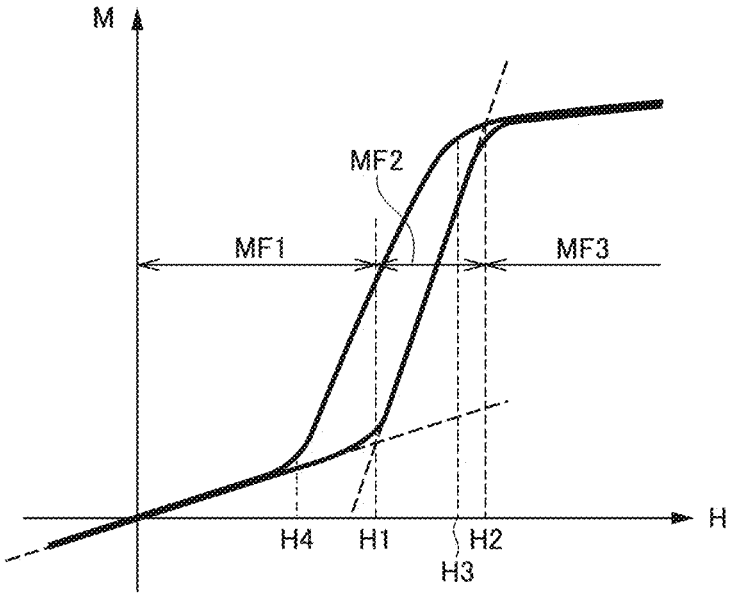
FIG. 3 is a graph illustrating the magnetic characteristics of the MnAl alloy exhibiting metamagnetism, where only the first quadrant (I) is illustrated.

FIG. 3 is a graph illustrating the magnetic characteristics of the MnAl alloy according to the present embodiment. In this graph, only the first quadrant (I) is illustrated.

The magnetic characteristics of the MnAl alloy according to the present embodiment will be described more specifically by way of FIG. 3. When the magnetic field is increased from a state where the magnetic field H is absent, the permeability is low in the region (first magnetic field region MF1) up to a first magnetic field strength H1, and thus increase in the magnetization M is small. The inclination of the graph, i.e., the differential value of the magnetization M with respect to the magnetic field H changes with the permeability. The permeability in the first magnetic field region MF1 is almost the same with the permeability of a non-magnetic material, so that the MnAl alloy according to the present embodiment behaves substantially as a non-magnetic material in the first magnetic field region MF1.

On the other hand, the permeability rapidly increases in the region (second magnetic field region MF2) from the first magnetic field strength H1 to a second magnetic field strength H2, and thus the value of the magnetization M significantly increases. That is, when the magnetic field is increased, the permeability rapidly increases with the first magnetic field strength H1 as a boundary. The permeability in the second magnetic field region MF2 is close to the permeability of a soft magnetic material, so that the MnAl alloy according to the present embodiment behaves as a soft magnetic material in the second magnetic field region MF2.

When the magnetic field is further increased to exceed the second magnetic field strength H2 (to reach a third magnetic field region MF3), magnetic saturation occurs, so that the inclination of the graph, i.e., the permeability reduces again.

Conversely, when the magnetic field is reduced from the third magnetic field region MF3 to fall below a third magnetic field strength H3, the permeability increases again in the region up to a fourth magnetic field region MF4. Then, the permeability reduces when the magnetic field falls below the fourth magnetic field strength H4, and the MnAl alloy according to the present embodiment behaves as a non-magnetic material again. As described above, the MnAl alloy according to the present embodiment has hysteresis in the first quadrant (I), but residual magnetization hardly exists, so that the same characteristics as those described above can be obtained when the magnetic field H is once set back to around zero.

Although the vertical axis indicates the magnetization M in the graphs illustrated in FIGS. 2 and 3, it may indicate a magnetic flux density B. Such substitution still can satisfy the relationship same with the former instance.

Figure 4:
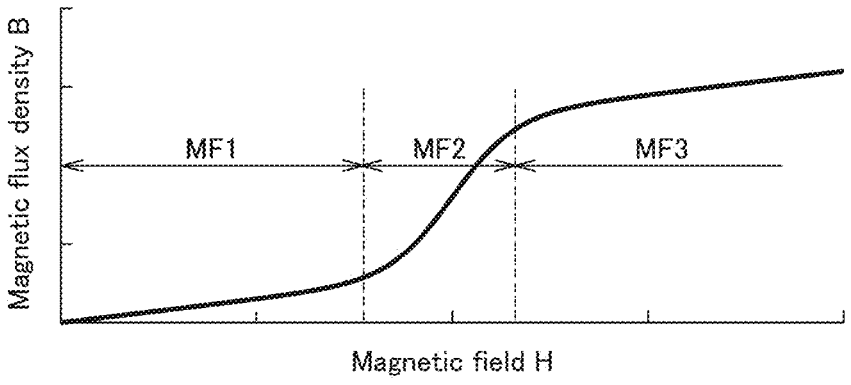
FIG. 4 is another graph illustrating the magnetic characteristics of the MnAl alloy exhibiting metamagnetism.

FIG. 4 is another graph illustrating the magnetic characteristics of the MnAl alloy according to the present embodiment. In this graph, the horizontal axis as a first axis indicates the magnetic field H, and the vertical axis as a second axis indicates the magnetic flux density B.

As illustrated in FIG. 4, even when the vertical axis indicates the magnetic flux density B, the magnetic characteristics of the MnAl alloy according to the present embodiment exhibits the same characteristic curve in the first quadrant (I) of the graph. That is, the inclination is small in the first magnetic field region MF1 with a low magnetic field, it rapidly becomes large in the second magnetic field region MF2 with a middle magnetic field, and it becomes small again in the third magnetic field region MF3 with a high magnetic field. Further, in the graph shown in FIG. 4, the characteristic curve representing the magnetic characteristics of the MnAl alloy according to the present embodiment passes substantially the origin of the graph and, even when the characteristic curve does not pass exactly the origin of the graph, it passes in the vicinity of the origin with respect to the horizontal or vertical axis.

Figure 5:
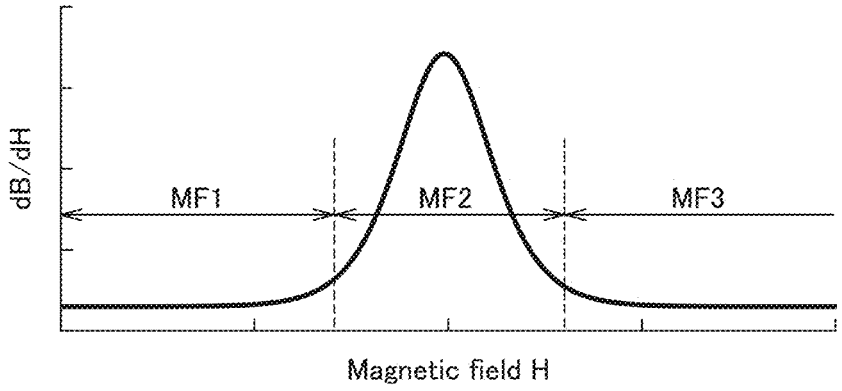
FIG. 5 is a graph illustrating the differential value of the characteristics illustrated in FIG. 4.
Figure 6:
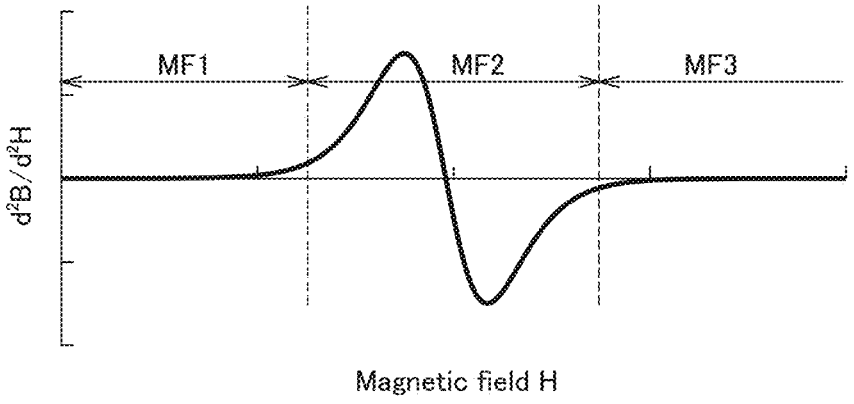

FIG. 5 is a graph illustrating the differential value of the characteristics illustrated in FIG. 4, and FIG. 6 is a graph illustrating the second order differential value of the characteristics illustrated in FIG. 4. The characteristics illustrated in FIG. 5 correspond to the differential permeability of the MnAl alloy according to the present embodiment.

As illustrated in FIG. 5, when the characteristics illustrated in FIG. 4 is subject to first order differentiation, the differential value becomes local maximum in the second magnetic field region MF2. In the first magnetic field region MF1 and third magnetic field region MF3, the differential value is still small. Then, as illustrated in FIG. 6, when the characteristics illustrated in FIG. 4 is subject to second order differentiation, the second order differential value is inverted from a positive value to a negative value in the second magnetic field region MF2. In the first magnetic field region MF1 and third magnetic field region MF3, the second order differential value is substantially zero. As described above, in the MnAl alloy according to the present embodiment, when the magnetic flux density B is subject to second order differentiation with respect to the magnetic field H, the second order differential value is inverted from a positive value to a negative value.

The MnAl alloy according to the present embodiment is obtained by electrolyzing molten salt in which a Mn compound and an AL compound are mixed and dissolved to deposit a MnAl alloy and then applying heat treatment to the MnAl alloy at a predetermined temperature.

Figure 7:
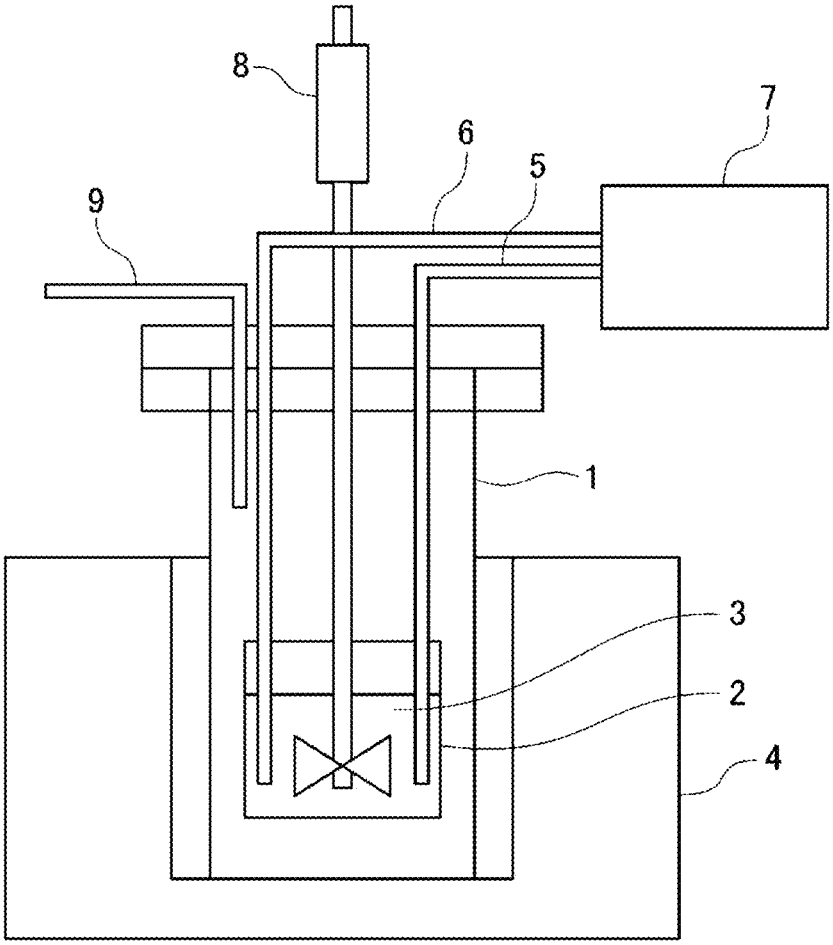
FIG. 7 is a schematic view of an electrodeposition apparatus for manufacturing the MnAl alloy.

FIG. 7 is a schematic view of an electrodeposition apparatus for manufacturing the MnAl alloy.

The electrodeposition apparatus illustrated in FIG. 7 has an alumina crucible 2 disposed inside a stainless sealed vessel 1. The alumina crucible 2 holds molten salt therein, and the molten salt 3 inside the alumina crucible 2 is heated by an electric furnace 4 disposed outside the sealed vessel 1. The alumina crucible 2 is provided inside thereof with a cathode 5 and an anode 6 immersed in the molten salt 3, and current is supplied to the cathode 5 and anode 6 through a constant current power supply device 7. The cathode 5 is a plate-like member made of Cu, and the anode 6 is a plate-like member made of Al. The molten salt 3 inside the alumina crucible 2 can be stirred by a stirrer 8. The sealed vessel 1 is filled with inert gas such as $N_2$ supplied through a gas passage 9.

The molten salt 3 contains at least a Mn compound and an Al compound. As the Mn compound, $MnCl_2$ can be used. As the Al compound, $AlCl_3$, $AlF_3$, $AlBr_3$, or $AlNa_3F_6$ can be used. The Al compound may be composed of $AlCl_3$ alone, and a part of $AlCl_3$ may be substituted with $AlF_3$, $AlBr_3$, or $AlNa_3F_6$.

The molten salt 3 may contain another halide in addition to the above-described Mn compound and Al compound. As another halide, an alkali metal halide such as NaCl, LiCl, or KCl is preferably selected, and a rare earth halide such as $LaCl_3$, $DyCl_3$, $MgCl_2$, $CaCl_2$, $GaCl_3$, $InCl_3$, $GeCl_4$, $SnCl_4$, $NiCl_2$, $CoCl_2$, or $FeCl_2$, an alkaline earth halide, a typical element halide, and a transition metal halide may be added to the alkali metal halide.

The above Mn compound, Al compound, and another halide are charged in the alumina crucible 2 and heated and melted by the electric furnace 4, whereby the molten salt 3 can be obtained. The molten salt 3 is preferably stirred sufficiently by the stirrer 8 immediately after melting so as to make the composition distribution of the molten salt 3 uniform.

The electrolysis of the molten salt 3 is performed by making current flow between the cathode 5 and the anode 6 through the constant current power supply device 7. This allows the MnAl alloy to be deposited on the cathode 5. The heating temperature of the molten salt 3 during the electrolysis is preferably 200° C. or more and 500° or less. The electricity amount is preferably 15 mAh or more and 150 mAh or less per electrode area of 1 $cm^2$. During the electrolysis, the sealed vessel 1 is preferably filled with inert gas such as $N_2$.

Further, the electricity amount of the current made to flow between the cathode 5 and the anode 6 is set to 50 mAh or more per 1 mass % concentration of the Mn compound in the molten salt 3 and per 1 $cm^2$ electrode area, whereby a powdery MnAl alloy can be deposited on the cathode 5. That is, the higher the concentration of the Mn compound in the molten salt 3, the more rapidly the deposition is accelerated, and the more the electricity amount per unit electrode area, the more rapidly the deposition is accelerated, and the MnAl alloy to be deposited easily becomes powdery when the above value range (50 mAh or more) is satisfied. When the MnAl alloy deposited on the cathode 5 is powdery, the deposition of the MnAl alloy is not stopped even when electrolysis is performed for a long time, thereby improving productivity of the MnAl alloy. Further, by compression molding the obtained powdery MnAl alloy, it is possible to obtain a desired product shape.

The initial concentration of the Mn compound in the molten salt 3 is preferably 0.2 mass % or more and, more preferably, 0.2 mass % or more and 3 mass % or less. Further, the Mn compound is preferably additionally thrown during electrolysis so as to maintain the concentration of the Mn compound in the molten salt 3. More specifically, powdery Mn compound or Mn compound in the form of pellets (obtained by molding powder) may additionally be thrown into the molten salt 3 continuously or periodically. When the Mn compound is additionally thrown during electrolysis of the molten salt 3, reduction in the concentration of the Mn compound associated with the progress of the electrolysis is suppressed, whereby the concentration of the Mn compound in the molten salt 3 can be maintained at a predetermined value or more. This makes it possible to suppress a variation in the composition of the MnAl alloy to be deposited.

The composition of the MnAl alloy deposited by electrodeposition is: Mn is 45 at % or more and less than 55 at %. When Al is more than 45 at % and 55 at % or less, substantially the entire MnAl alloy is deposited as the τ-MnAl phase. When heat treatment is applied to the MnAl alloy of the τ-MnAl phase at 400° C. or more and less than 600° C., a part of the τ-MnAl phase changes to the γ2-MnAl phase or β-MnAl phase. This is presumably because the movement of Al caused by heat treatment causes an Al-rich region where the Al concentration has increased to change to the γ2-MnAl phase and causes a region where the Al concentration has reduced to change to the τ-MnAl phase, and also because the movement of Mn caused by heat treatment causes a Mn-rich region where the Mn concentration has increased to change to the β-MnAl phase and causes a region where the Mn concentration has reduced to change to the τ-MnAl phase. The ratio among the τ-MnAl phase, γ2-MnAl phase, and β-MnAl phase changes according to electrodeposition temperature and heat treatment temperature.

Further, the ratio (B/C) between the γ2-MnAl phase and the β-MnAl phase after heat treatment depends on the Mn concentration in the τ-MnAl phase and, the lower the Mn concentration in the τ-MnAl phase is, the higher the ratio (B) of the γ2-MnAl phase becomes, and the higher the Mn concentration in the τ-MnAl phase is, the higher the ratio (C) of the β-MnAl phase becomes. The τ-MnAl phase having high Mn concentration tends to have a large maximum magnetization value.

Figure 8:
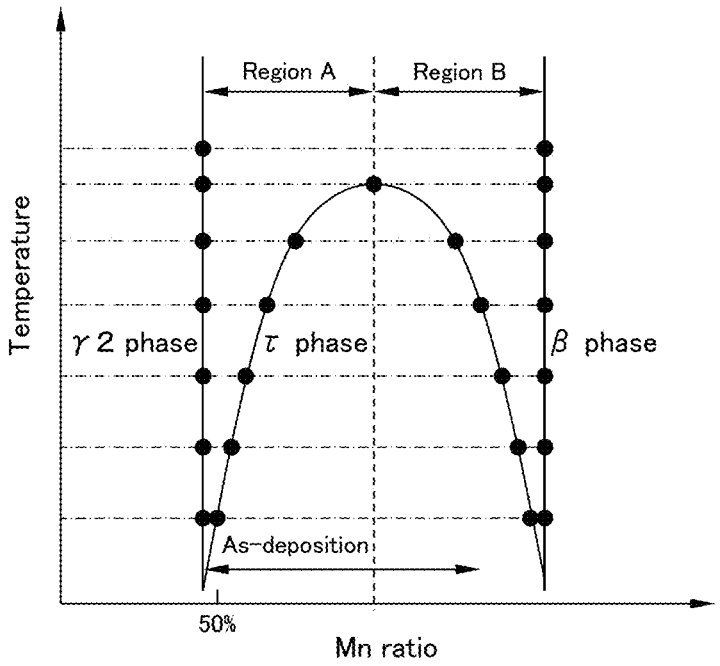
FIG. 8 is a schematic phase diagram of the MnAl alloy.

FIG. 8 is a schematic phase diagram of the MnAl alloy. In FIG. 8, the horizontal axis indicates Mn ratio, and the vertical axis indicates temperature. The phase diagram illustrated in FIG. 8 is partially based on estimation instead of real measurement.

As illustrated in FIG. 8, when a MnAl alloy in which Mn atomic ratio is 50% is produced by electrodeposition method, substantially the entire MnAl alloy becomes the τ-phase; however, a predetermined distribution occurs in the Mn atomic ratio. That is, a region with high Mn atomic ratio and a region with low Mn atomic ratio exist. Then, when heat treatment is applied to this MnAl alloy, the movement of Al and Mn causes a part of the τ-MnAl phase change to the γ2-MnAl phase or β-MnAl phase. Points denoted by a black circle in FIG. 8 represent phases existing in the respective temperatures. As illustrated, a region A where the Mn ratio in the τ-MnAl phase becomes higher as the temperature gets higher and a region B where the Mn ratio in the τ-MnAl phase becomes higher as the temperature gets lower exist. In the region A, the Mn ratio in the γ2-MnAl phase hardly changes even when the temperature rises and, in the region B, the Mn ratio in the β-MnAl phase hardly changes even when the temperature lowers. From the factor, it is thought that when the movement of Al occurs due to the application of heat treatment, a region taking in the moving Al changes to the γ2-MnAl phase, while the Mn concentration in a region losing Al gradually increases, and that when the movement of Mn occurs due to the application of heat treatment, a region taking in the moving Mn changes to the β-MnAl phase, while the Mn concentration in a region losing Mn gradually reduces.

However, when the heat treatment temperature exceeds a predetermined value, the τ-MnAl phase cannot exist, resulting in a state where only the γ2-MnAl phase and β-MnAl phase coexist. In this state, the τ-MnAl phase is absent, so that magnetism is lost.

It is estimated that by such a mechanism, the application of heat treatment causes the ratio among the τ-MnAl phase, γ2-MnAl phase, and β-MnAl phase and the Mn concentration in the τ-MnAl phase to change. Assuming that the ratio of the τ-MnAl phase is A, the ratio of the γ2-MnAl phase is B, and the ratio of the β-MnAl phase is C, when $75\% \leq A \leq 99\%$, preferably, $95\% \leq A \leq 99\%$ is satisfied, and $B < C$, preferably, $0.01 \leq B/C \leq 0.17$ is satisfied, the saturation magnetism of the MnAl alloy having metamagnetism can be enhanced.

The MnAl alloy according to the present embodiment can be applied to various electronic components. For example, when the MnAl alloy according to the present embodiment is used as a magnetic core, application to a reactor, an inductor, a current limiter, an electromagnetic actuator, a motor, or the like is possible. Further, when the MnAl alloy according to the present embodiment is used as a magnetic refrigeration substance, application to a magnetic refrigerator is possible.

It is apparent that the present invention is not limited to the above embodiments, but may be modified and changed without departing from the scope and spirit of the invention.

EXAMPLES

<Production of MnAl Alloy by Electrolysis Method>

First, an electrodeposition apparatus having the structure illustrated in FIG. 7 was prepared. As the cathode 5, a Cu plate having a thickness of 3 mm cut out so as to set the immersion area into the molten salt 3 to a size of 5 cm×8 cm was used. As the anode 6, an Al plate having a thickness of 3 mm cut out so as to set the immersion area into the molten salt 3 to a size of 5 cm×8 cm was used.

Then, 50 mol % anhydrous $AlCl_3$ which is an Al compound, 50 mol % NaCl which is another halide, and 1 mass % $MnCl_2$ dehydrated in advance as the Mn compound are weighed and thrown into the alumina crucible 2 such that the total weight thereof was 1200 g. Thus, the weight of $MnCl_2$ was g. The dehydration was performed by heating $MnCl_2$ hydrate at about 400° C. for four hours or longer in an inert gas atmosphere such as $N_2$.

The alumina crucible 2 into which the materials had been thrown was moved inside the sealed vessel 1, and the materials were heated to 350° C. by the electric furnace 4, whereby the molten salt 3 was obtained. Then, rotary vanes of the stirrer 8 were sunk into the molten salt 3, and stirring was performed at a rotation speed of 300 rpm for 0.5 hours. Thereafter, in the state where the temperature of the molten salt 3 is kept at 200° C., 250° C., 300° C., 350° C., 400° C., 450° C., or 500° C., a constant current of 60 mA/cm$^2$ (2.4 A) per unit electrode area was conducted between the cathode 5 and the anode 6 for four hours, and the current conduction and heating were stopped. Then, the electrode was removed before the molten salt 3 would become cool and solid, and the cathode 5 is subjected to ultrasonic washing using acetone. A film-like electrodeposit and powdery electrodeposits (MnAl alloy) were deposited on the surface of the cathode 5. The film-like electrodeposit was collected by dissolving and removing Cu constituting the cathode 5 and pulverized with a mortal into powder. Some of the powdery electrodeposits were left on the cathode 5, but the rest were deposited on the bottom portion of the alumina crucible 2. Therefore, the powdery electrodeposits sunk into the molten salt 3 were filtered and collected. At the same time, the molten salt was subjected to decantation, and the mixture of the powdery electrodeposits left on the bottom portion and the molten salt was cooled and solidified, followed by washing using acetone and filtering/collection. The powdery electrodeposits obtained by both the above collection methods were mixed with a powdery sample obtained by pulverizing the film-like electrodeposit.

<Heat Treatment for MnAl Alloy>

Powder samples obtained at electrodeposition temperatures of 200° C., 250° C., 300° C., 350° C., 400° C., 450° C. and 500° C. were used as Comparative Examples 1 to 7, respectively.

The powder sample of Comparative Example 1 was subjected to heat treatment at 400° C., 450° C., 500° C., 550° C., or 600° C. for 16 hours in an Ar atmosphere. A sample obtained at 400° C. was used as Example 1, a sample obtained at 450° C. was used as Example 2, a sample obtained at 500° C. was used as Example 3, a sample obtained at 550° C. was used as Example 4, and a sample obtained at 600° C. was used as Comparative Example 8.

The powder sample of Comparative Example 2 was subjected to heat treatment at 400° C., 450° C., 500° C., 550° C., or 600° C. for 16 hours in an Ar atmosphere. A sample obtained at 400° C. was used as Example 5, a sample obtained at 450° C. was used as Example 6, a sample obtained at 500° C. was used as Example 7, a sample obtained at 550° C. was used as Example 8, and a sample obtained at 600° C. was used as Comparative Example 9.

The powder sample of Comparative Example 3 was subjected to heat treatment at 400° C., 450° C., 500° C., 550° C., or 600° C. for 16 hours in an Ar atmosphere. A sample obtained at 400° C. was used as Example 9, a sample obtained at 450° C. was used as Example 10, a sample obtained at 500° C. was used as Example 11, a sample obtained at 550° C. was used as Example 12, and a sample obtained at 600° C. was used as Comparative Example 10.

The powder sample of Comparative Example 4 was subjected to heat treatment at 400° C., 450° C., 500° C., 550° C., or 600° C. for 16 hours in an Ar atmosphere. A sample obtained at 400° C. was used as Example 13, a sample obtained at 450° C. was used as Example 14, a sample obtained at 500° C. was used as Example 15, a sample obtained at 550° C. was used as Example 16, and a sample obtained at 600° C. was used as Comparative Example 11.

The powder sample of Comparative Example 5 was subjected to heat treatment at 400° C., 450° C., 500° C., 550° C., or 600° C. for 16 hours in an Ar atmosphere. A sample obtained at 400° C. was used as Example 17, a sample obtained at 450° C. was used as Example 18, a sample obtained at 500° C. was used as Example 19, a sample obtained at 550° C. was used as Example 20, and a sample obtained at 600° C. was used as Comparative Example 12.

The powder sample of Comparative Example 6 was subjected to heat treatment at 400° C., 450° C., 500° C., 550° C., or 600° C. for 16 hours in an Ar atmosphere. A sample obtained at 400° C. was used as Example 21, a sample obtained at 450° C. was used as Example 22, a sample obtained at 500° C. was used as Example 23, a sample obtained at 550° C. was used as Example 24, and a sample obtained at 600° C. was used as Comparative Example 13.

The powder sample of Comparative Example 7 was subjected to heat treatment at 400° C., 450° C., 500° C., 550° C., or 600° C. for 16 hours in an Ar atmosphere. A sample obtained at 400° C. was used as Example 25, a sample obtained at 450° C. was used as Example 26, a sample obtained at 500° C. was used as Example 27, a sample obtained at 550° C. was used as Example 28, and a sample obtained at 600° C. was used as Comparative Example 14.

<Production of MnAl Alloy by Melting Method>

Mn metal of purity 99.9 mass % or more and Al metal of purity 99.9 mass % or more were weighed in a ratio of 55 at %:45 at % and subjected to arc melting in an Ar atmosphere to produce a raw material ingot.

The obtained raw material ingot was subjected to heat treatment at 1150° C. in an Ar atmosphere for two hours, followed by in-water rapid quenching. Thereafter, the resultant ingot was subjected to heat treatment at 600° C. in an Ar atmosphere for one hour, followed by slow cooling. Thereafter, the resultant ingot was pulverized in a stamp mill to obtain powder of 100 μm or less. The obtained sample was used as Comparative Example 15.

<Measurement of Ratio among τ-Phase, γ2-Phase, and β-Phase>

1. XRD Measurement

Diffraction intensity was measured in a range of 20° to 80° with a scanning interval of 0.020° and measurement time of 1.2 seconds at room temperature by Cuα1 radiation using an X-ray diffraction measuring apparatus (XRD, manufactured by Rigaku).

2. Mass Fraction Using Rietvelt Analysis

The mass fractions of the respective τ-phase, γ2-phase, and β-phase were calculated using Rietvelt analysis software "RIETAN-FP".

The XRD measurement and Rietvelt analysis each calculate the mass fractions of the respective τ-phase, γ2-phase, and β-phase in the entire sample, and the calculation results thereof do not always coincide with evaluation values using TEM.

<Evaluation of Presence/Absence of Inflection Point of Magnetization Curve at Room Temperature and Squareness Ratio>

Magnetic characteristics were measured in a magnetic field range of 0 kOe to 100 kOe at room temperature using a pulsed high field magnetometer (Toei Industry Co., Ltd.), and the presence/absence of an inflection point indicating metamagnetism was determined based on an obtained magnetization curve. Further, mass magnetization at 100 kOe was set as maximum mass magnetization σmax, magnetization around 0 kOe was set as residual mass magnetization σr, and the ratio σr/σmax was set as a squareness ratio. A sample having a squareness ratio of 0.1 or more was determined to have residual magnetization, and a sample having a squareness ratio of less than 0.1 was determined not to have residual magnetization.

<Evaluation Results>

Evaluation results are shown in FIG. 9.

As illustrated in FIG. 9, the samples of Comparative Examples 1 to 6 which have not been subjected to heat treatment have only the τ-MnAl phase and thus do not have metamagnetism. Similarly, the sample of Comparative Example 15 produced by a melting method has only the τ-MnAl phase and thus does not have metamagnetism. On the other hand, the sample of Comparative Example 7 which has not been subjected to heat treatment have the τ-MnAl phase and γ2-MnAl phase, but does not have metamagnetism.

The samples of Comparative Examples 8 to 14 which have been subjected to heat treatment of 600° C. have the τ-MnAl phase, γ2-MnAl phase, and β-MnAl phase, but do not have metamagnetism. The results can presumably be explained by that many of the τ-MnAl phases change to the γ2-MnAl phase or β-MnAl phase due to excessively high heat treatment temperature to reduce the ratio of the residual τ-MnAl phase.

Unlike the above Comparative Examples 1 to 15, all the samples of Examples 1 to 28 have the τ-MnAl phase, γ2-MnAl phase, and β-MnAl phase and thus have metamagnetism.

Figure 10:
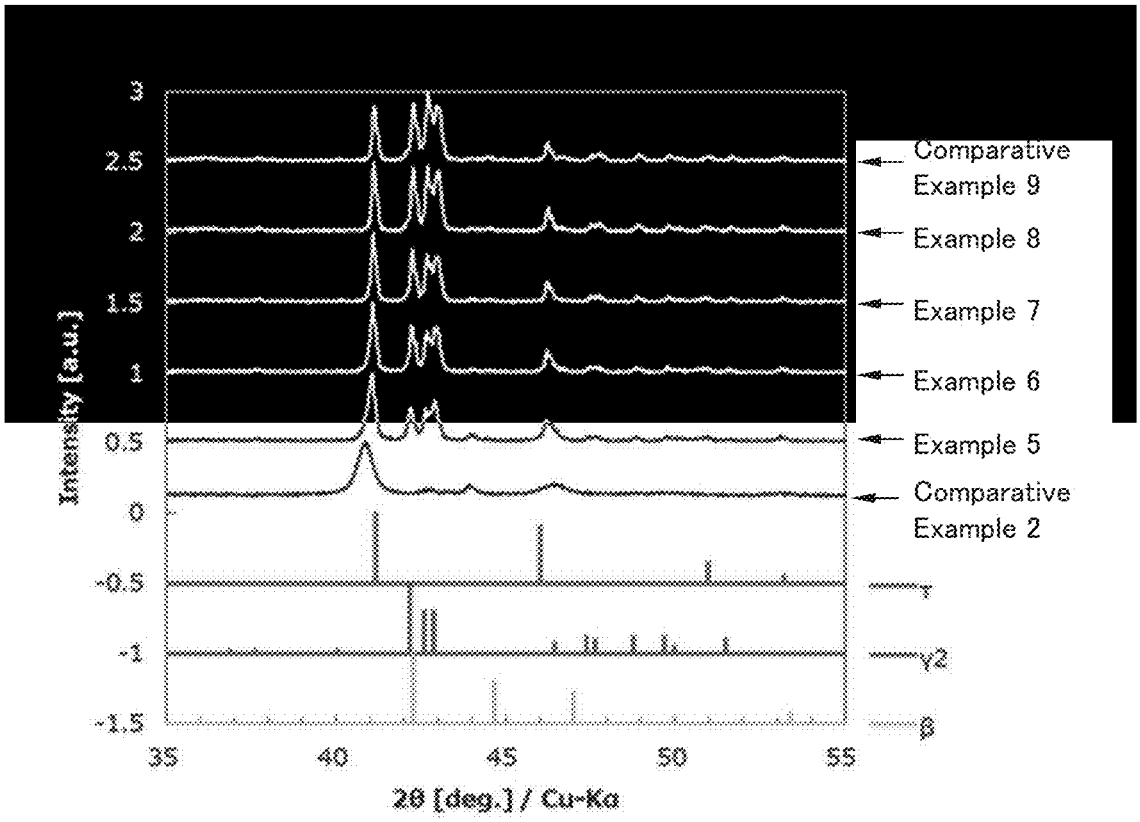
FIG. 10 is a view illustrating XRD measurement results of Comparative example 2, Examples 5 to 8, and Comparative Example 9.

FIG. 10 is a view illustrating XRD measurement results of Comparative example 2 (electrodeposition temperature: 250° C., without heat treatment), Examples 5 to 8 (electrodeposition temperature: 250° C., with heat treatment at 400° C. to 550° C.), and Comparative Example 9 (electrodeposition temperature: 250° C., with heat treatment at 600° C.). As is clear from FIG. 10, in the case of 250° C. electrodeposition temperature, the higher the heat treatment temperature is, the less the amount of the τ-MnAl phase becomes and the more the amount of the γ2-MnAl phase becomes. However, the β-MnAl phase is only slightly generated even heat treatment is applied.

Figure 11:
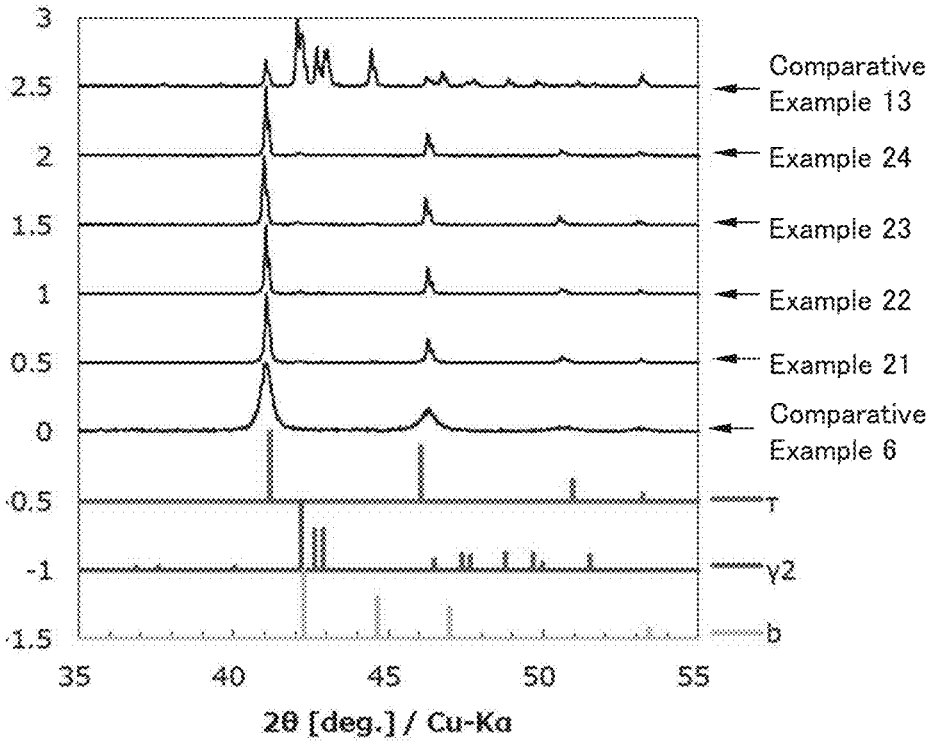
FIG. 11 is a view illustrating XRD measurement results of Comparative example 6, Examples 21 to 24, and Comparative Example 13.
Figure 12:
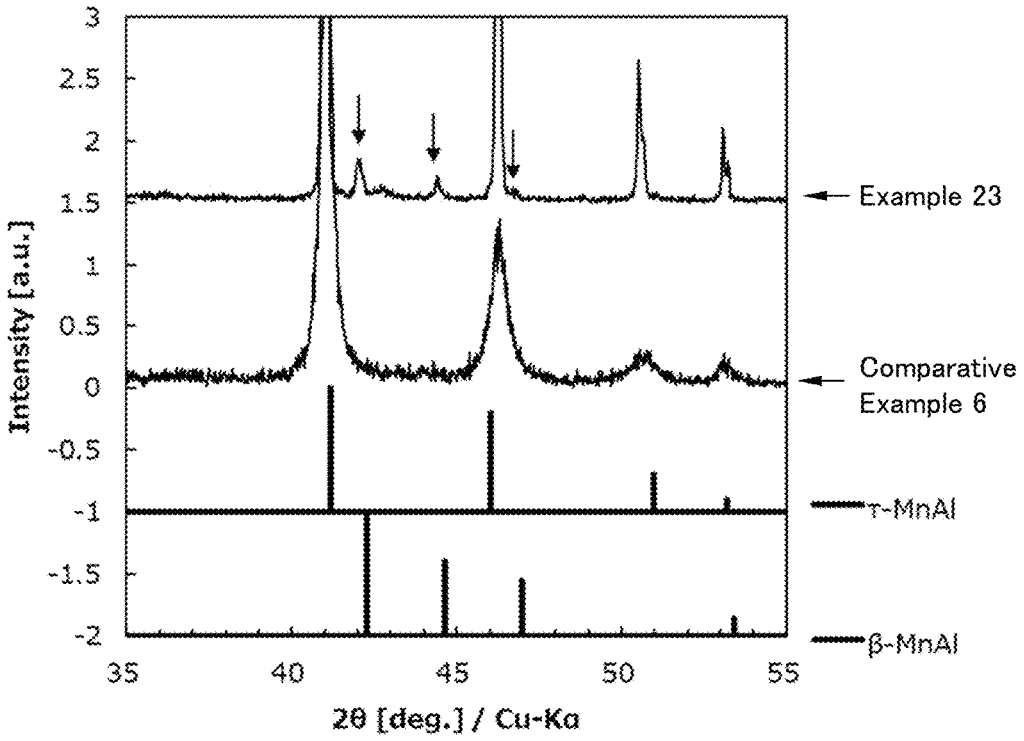
FIG. 12 is an enlarged view of the XRD measurement results of Comparative Example 6 and Example 23.

FIG. 11 is a view illustrating XRD measurement results of Comparative example 6 (electrodeposition temperature: 450° C., without heat treatment), Examples 21 to 24 (electrodeposition temperature: 450° C., with heat treatment at 400° C. to 550° C.), and Comparative Example 13 (electrodeposition temperature: 450° C., with heat treatment at 600° C.). FIG. 12 is an enlarged view of the XRD measurement results of Comparative Example 6 and Example 23. As is clear from FIG. 11, in the case of 450° C. electrodeposition temperature, even when heat treatment is applied, reduction in the amount of the τ-MnAl phase is small, and the γ2-MnAl phase is only slightly generated. On the other hand, as is clear from FIG. 12, the β-MnAl phase is generated by heat treatment.

FIGS. 13A to 13C are tables showing the maximum magnetization, τ-phase ratio, and γ2-phase/β-phase intensity ratio, respectively, rearranged in terms of the electrodeposition temperature and heat treatment temperature.

Shaded cells in FIG. 13A indicate samples having a large maximum magnetization value (95 emu/g or more) and, among them, cells shown in bold indicate samples having a particularly large maximum magnetization value (130 emu/g or more). As is clear from FIG. 13A, when the electrodeposition temperature is 300° C. to 500° C., and heat treatment temperature is 400° C. to 550° C., the maximum magnetization value becomes large, and when the electrodeposition temperature is 350° C. to 450° C., and heat treatment temperature is 400° C. to 550° C., the maximum magnetization value becomes particularly large.

Shaded cells in FIG. 13B indicate samples having a high τ-phase ratio (A=90% or more) and, among them, cells shown in bold indicate samples having a particularly high τ-phase ratio (A=95% or more). As is clear from FIG. 13B, when the heat treatment temperature is high, the τ-phase ratio tends to be reduced, while when the electrodeposition temperature is high, reduction in the τ-phase ratio in accordance with the heat treatment temperature becomes small. For example, when the electrodeposition temperature is 350° C. to 450° C., the τ-phase ratio is maintained at 95% or more irrespective of the heat treatment temperature. As is clear from comparison between FIGS. 13A and 13B, there is a correlation between the τ-phase ratio and the maximum magnetization.

Shaded cells in FIG. 13C indicate samples having a low γ2-phase/β-phase intensity ratio (B/C=1.3 or less) and, among them, cells shown in bold indicate samples having a particularly low γ2-phase/β-phase intensity ratio (B/C=0.17 or less) (samples not having metamagnetism are excluded). As is clear from comparison between FIGS. 13A and 13C, there is a correlation between the γ2-phase/β-phase intensity ratio and maximum magnetization, and areas having a low γ2-phase/β-phase intensity ratio and areas having a high maximum magnetization almost perfectly overlap each other.

FIGS. 13A to 13C suggest that large magnetization can be obtained when the amount of the τ-MnAl phase reduced due to heat treatment is small and the β-MnAl phase is generated on a larger scale than the γ2-MnAl phase.

Then, magnetic characteristics were evaluated in a temperature range of −100° C. to 200° C. for Example 11 and Comparative Examples 3 and 15. The results are shown in FIG. 14.

As shown in FIG. 14, the sample of Example 11 exhibits metamagnetism over a wide temperature range of −100° C. to 200° C.

What is claimed is:

1. A material, comprising:

an MnAl alloy that is deposited by electrolyzing molten salt containing a Mn compound and an Al compound at a temperature of 350° C. or more and 450° C. or less and that is heat-treated at a temperature of 400° C. or more and less than 600° C., such that the deposited and heat-treated MnAl alloy comprises crystal grains including τ-MnAl phase and crystal grains including γ2-MnAl phase and β-MnAl phase and exhibits metamagnetism.

2. The material as claimed in claim 1, wherein 75%≤A≤99% is satisfied when a ratio of the τ-MnAl phase is A.

3. The material as claimed in claim 2, wherein 95%≤A≤99% is satisfied.

4. The material as claimed in claim 2, wherein B<C is satisfied when ratios of the γ2-MnAl phase and β-MnAl phase are B and C, respectively.

5. The material as claimed in claim 4, wherein 0.01≤B/C≤0.17 is satisfied.

6. A method for manufacturing a MnAl alloy, the method comprising:

a step of depositing a MnAl alloy by electrolyzing molten salt containing a Mn compound and an Al compound at a temperature of 350° C. or more and 450° C. or less; and a step of applying heat treatment to the MnAl alloy at a temperature of 400° C. or more and less than 600° C., such that the deposited and heat-treated MnAl alloy comprises crystal grains including τ-MnAl phase and crystal grains including γ2-MnAl phase and β-MnAl phase and exhibits metamagnetism.

* * * * *